United States Patent [19]

Kenmochi

[11] 4,445,840

[45] May 1, 1984

[54] PRESSURE CYLINDER APPARATUS AND HYDRAULIC PRESS INCORPORATING THE SAME

[75] Inventor: Takeji Kenmochi, Shizuoka, Japan

[73] Assignee: Kohtaki & Co., Ltd., Tokyo, Japan

[21] Appl. No.: 456,207

[22] Filed: Jan. 7, 1983

[30] Foreign Application Priority Data

Jun. 11, 1982 [JP] Japan ..... 57-99186

[51] Int. Cl.[3] ..... B30B 1/32; B30B 11/02

[52] U.S. Cl. ..... 425/450.1; 425/352; 425/406; 92/177; 92/110

[58] Field of Search ..... 425/28 R, 33, 34 R, 425/34 A, 352, 354, 355, 405 A, 406, 149, 78, 450.1; 92/177, 110

[56] References Cited

U.S. PATENT DOCUMENTS

| | | | |
|---|---|---|---|
| 1,412,119 | 4/1922 | Laussuco | 425/28 R |
| 2,259,781 | 10/1941 | Shaw et al. | 425/149 X |
| 2,338,491 | 1/1944 | Cutler | 425/149 X |
| 2,358,765 | 9/1944 | Stadlin | 425/149 X |
| 3,180,236 | 4/1965 | Beckett | 92/177 X |
| 4,080,877 | 3/1978 | de Fries | 92/177 X |

*Primary Examiner*—J. Howard Flint, Jr.

*Attorney, Agent, or Firm*—Flynn, Thiel, Boutell & Tanis

[57] ABSTRACT

Disclosed is a pressure cylinder apparatus having a cylinder and a slidable member such as a ram or piston which is slidable back and forth in response to charging and discharging of fluid into and out of the cylinder, wherein that the said slidable member has a polygonal cross-sectional shape and that the said stopper assembly having an aperture of a polygonal shape corresponding to the polygonal cross-section of the slidable member is provided in the plane perpendicular to the direction of movement of the slidable member so that the stopper assembly prevents or limits the undesirable rotation of the slidable member during outward movement of the slidable member, and disclosed also is a hydraulic press incorporating the pressure cylinder apparatus stated above, and the end surface of the said slidable member is shaped and sized to conform with the press mold part to which the end surface portion is connected.

11 Claims, 6 Drawing Figures

PRESSURE CYLINDER APPARATUS AND HYDRAULIC PRESS INCORPORATING THE SAME

BACKGROUND OF THE INVENTION

The present invention relates to a pressure cylinder apparatus and to a hydraulic press incorporating the same.

As is well known, a hydraulic cylinder apparatus has a cylinder and a ram or piston (referred to as "slidable member", hereinunder) received by the cylinder, the slidable member being slidable outwardly and inwardly of the cylinder by fluid pressure applied to the slidable member in the cylinder, so that a force is applied to a member or a machine part fixed to the slidable member thereby to perform a desired work. In the operation of the pressure cylinder apparatus, therefore, the supply and discharge of the fluid to and from the cylinder is essential. As a matter of fact, the pressurizing force of the fluid introduced into the cylinder and acting on the piston has a certain directivity on the sliding movement of the slidable member. More specifically, it is well known that the slidable member is rotated more or less when it is forced out from the cylinder. This does not matter if the slidable member is allowed to rotate while moving ahead. However, in the case where the rotation of the slidable member during linear forward movement is strictly forbidden, it is necessary to employ a considerably complicated guide means for preventing the slidable member from rotating. The size of the guide means is increased and the construction of the same is complicated as the whole apparatus becomes larger in size and complicated in construction.

DESCRIPTION OF THE PRIOR ART

Insofar as the present applicant knows, a prior art which seems to resemble the present invention is disclosed in the specification of Japanese Utility Model Application No. 83977/78, (First Publication (Kokai) No. 3002/80). This prior art, however, relates to an apparatus incorporating a piston rod having a non-circular and smooth cross-sectional shape. The Japanese Utility Model Application No. 83977/78 mentions U.S. Pat. No. 2,956,549 as disclosing a pertinent art. This art, however, seems not to be relevant to the present invention. This U.S. patent states that, when this art is intended for prevention of rotation of rod in an apparatus in which the leak of pressurized fluid does not matter, the art can suitably be applied to a double acting cylinder which, however, requires a cylinder length almost twice as large as that of the conventional cylinder.

SUMMARY OF THE INVENTION

Under these circumstances, the present invention aims as its primary object at providing a pressure cylinder apparatus which can prevent or limit the rotation of the slidable member thereby to overcome the problem involved by the conventional cylinder apparatus, as well as a hydraulic press incorporating this improved cylinder apparatus and, hence, having a simplified construction.

Other objects, features and advantages of the invention will become clear from the following description of the preferred embodiments taken in conjunction with the accompanying drawings.

DETAILED DESCRIPTION OF THE PREFERRED EMBODIMENTS

Before turning to the description of the preferred embodiment, a description will be made hereinunder as to a hydraulic press incorporating a conventional pressure cylinder apparatus.

Figure 1:
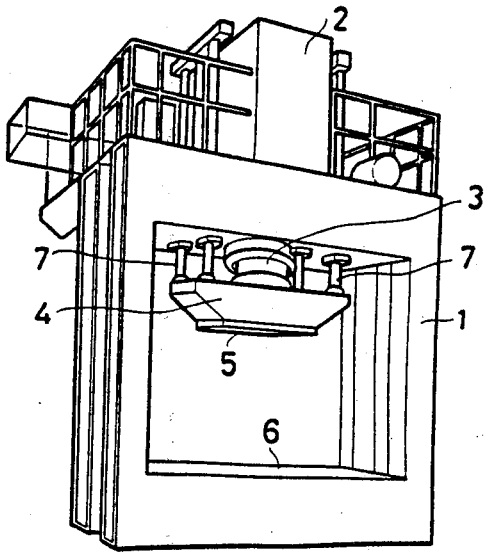
FIG. 1 is a schematic perspective view of a conventional hydraulic press apparatus.

A typical conventional hydraulic press incorporates, as shown in FIG. 1, a pressure cylinder apparatus 2 disposed above the gate-type frame 1. A ram 3 as a slidable member is movable outwardly of the cylinder of the cylinder apparatus 2, i.e. downwardly and inwardly of the same, i.e. upwardly. A table 4 is secured to the ram 3. As the ram 3 is moved downwardly and upwardly, an upper mold part 5 fixed to the table 4 is moved towards and away from a lower mold part (not shown) which is situated on a press bed 6. In this hydraulic press, needless to say, it is essential to precisely set the upper and lower mold parts with respect to each other and, hence, the rotation of the ram 3 during downward movement should be avoided strictly. To avoid the rotation of the ram 3, in this conventional hydraulic press, a plurality of guide bars 7 are arranged on the gate-type frame 1 and are connected to the table 4 so as to prevent the rotation of the table 4, i.e. the rotation of the ram 3. Thus, in the case where the rotation of the slidable member 3 during forward movement of the same has to be avoided strictly, it is necessary to employ a considerably complicated guide means. The construction of the guide means will be further complicated if the scale of the apparatus as a whole is increased.

The above-described problem of the prior art can effectively be overcome by the present invention, as will be fully understood from the following description of two preferred embodiments of the pressure cylinder apparatus of the invention and a preferred embodiment of the hydraulic press incorporating the pressure cylinder apparatus.

Figure 2:
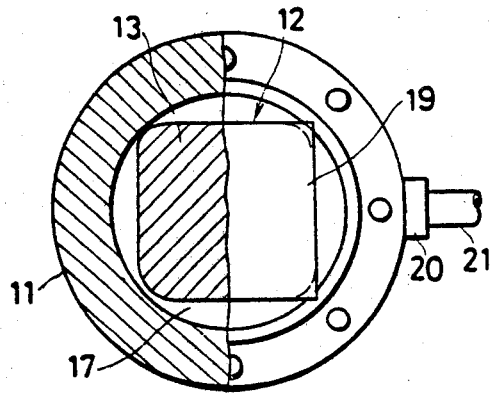
FIG. 2 is a sectional view of a practical embodiment (the first embodiment) of the invention taken along the line II—II of FIG. 3.
Figure 3:
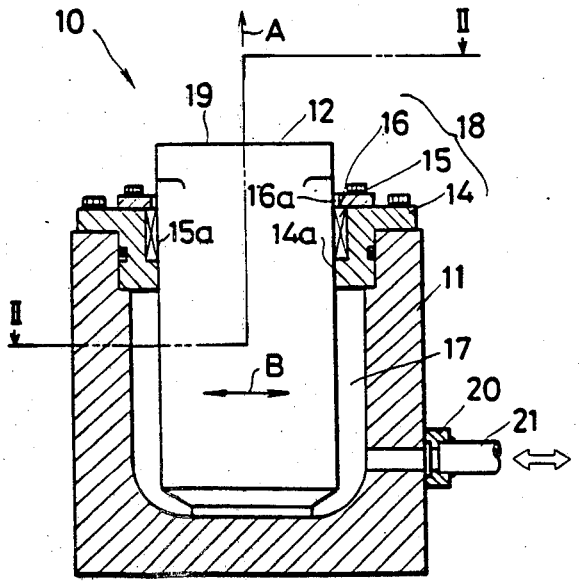
FIG. 3 is a vertical sectional view of the practical embodiment (the first embodiment) of the invention.

FIGS. 2 and 3 show a first embodiment of the "pressure cylinder apparatus" in accordance with a first embodiment of this application.

This pressure cylinder apparatus, generally designated at a numeral 10, has a single acting type cylinder 11 and a ram, i.e. the slidable member 12 which is movable outwardly (upwardly) and inwardly (downwardly) of the cylinder 11. The slidable member 12 has a polygonal cross-section which is designated in the drawings at a reference numeral 13. The term cross-section is used here to mean a section taken along a plane extending in the direction of arrows B which is perpendicular to the direction A of movement of the slidable member 12.

The cylinder 11 is provided at its open end, i.e. at the end thereof in the direction of outward movement of the cylinder in the direction of the arrow of A of a slidable member 12, with a stopper assembly 18 which is composed of a stuffing box 14, packing and a packing gland 15, a packing retainer 16 and so forth, so as to extend in a plane extending in the perpendicular direction of arrow B. The stopper assembly 18 functions also as a seal for preventing pressurized fluid from flowing out of the pressure chamber 17. The sealing stopper assembly 18 is provided with a polygonal shape corresponding to the polygonal cross-section of the slidable member 12. The polygonal apertures in the stuffing box 14, packing and packing gland 15 and the packing retainer 16 are designated at reference numerals 14*a*, 15*a* and 16*a*, respectively. In the drawings, a reference numeral 19 designates an end surface of the slidable member 12, 20 denotes a connecting flange and 21 denotes a pipe for charging and discharging pressurized fluid.

In operation, a pressurized fluid such as pressurized oil is supplied from a pipe 21 into the pressure chamber 17, so that the ram as the slidable member 12 is moved outwardly, i.e. upwardly. As stated before, in the apparatus of the invention, the slidable member 12 has a polygonal cross-section and is received by the aperture of the same polygonal shape formed in the sealing stopper member 18 which is provided on the end of the cylinder 11. Therefore, the slidable member is allowed to slide without making any rotation around its own axis. In this embodiment, the pressure cylinder apparatus is of single acting type, so that the retracting or inward movement, i.e. the downward movement, of the slidable member is effected by the force of gravity or, alternatively, by a suitable pressing means which is not shown.

Figure 4:
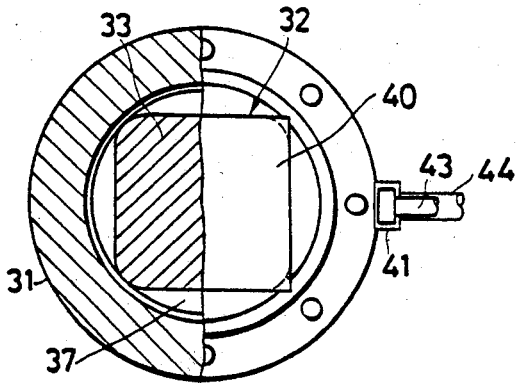
FIG. 4 is a sectional view of another practical embodiment of the invention (different than the first embodiment) taken along the line IV—IV in FIG. 5.
Figure 5:
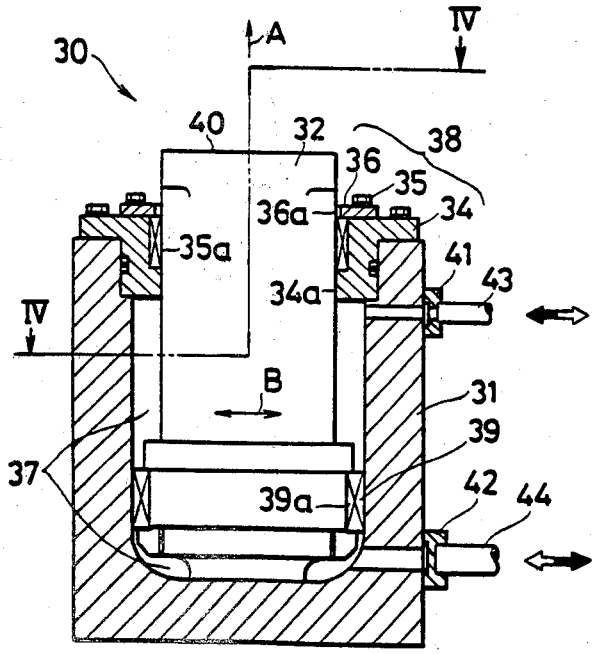
FIG. 5 is a vertical sectional view of another practical embodiment of the invention (different than the first embodiment).

FIGS. 4 and 5 show a second embodiment of the "pressure cylinder apparatus" in accordance with a first form of the invention. This pressure cylinder apparatus 30 has a double-acting type cylinder 31 which receives a piston as the slidable member 32 for free sliding movement outwardly (upwardly) and inwardly (downwardly) of the cylinder 31. This slidable member 32 has a polygonal cross-sectional shape as indicated by an arrow 33. As in the case of the first embodiment, the term "cross-section" is used to mean a section taken in a plane extending in the directions of arrows B which intersects perpendicularly the direction of movement of the slidable member 32 indicated by arrow A.

The cylinder 31 is provided at its end in the direction A of movement with a stopper assembly 38 constituted by a stuffing box 34, packing and packing gland 35, packing retainer 36. The stopper assembly 38 serves also as a seal for preventing escape of pressurized fluid, and extends in a plane perpendicular to the direction A of sliding of the slidable member 32, i.e. in a plane perpendicular to the direction B. Similarly, a packing and a packing gland 39 are secured to the slidable member 32. The sealing stopper assembly 38 and the packing gland 39 have apertures of polygonal shape which conforms with the polygonal cross-sectional shape of the slidable member 32. More specifically, the polygonal apertures in the stuffing box 34, packing and packing gland 35, packing retainer 36 and the packing and packing gland 39 are designated, respectively, by numerals 34*a*, 35*a*, 36*a* and 39*a*.

In the drawings, a reference numeral 40 denotes an end surface of the slidable member 32. Numerals 41 and 42 denote, respectively, connecting flanges while numerals 43 and 44 denote pressurized fluid charging and discharging pipes, respectively.

In operation, for moving the slidable member 32 outwardly of the cylinder, i.e. upwardly, a pressurized fluid such as a pressurized oil is supplied to the cylinder through the pipe 44 into the pressure chamber 37 thereby to establish a high fluid pressure in the latter so that the slidable member 32 is moved in the direction of arrow A. It will be seen that the slidable member 32 is allowed to move linearly but not to rotate because the slidable member 32 having a polygonal cross-section is received by the aperture in the sealing stopper assembly having the same polygonal shape.

To the contrary, for moving the slidable member 32 inwardly of the cylinder, it suffices only to supply the pressure chamber 37 with the pressurized fluid. The slidable member 32 moves only linearly but not rotatably even in the returning stroke thereof, due to the cooperation between the slidable member 32 and the stopper assembly 38.

Figure 6:
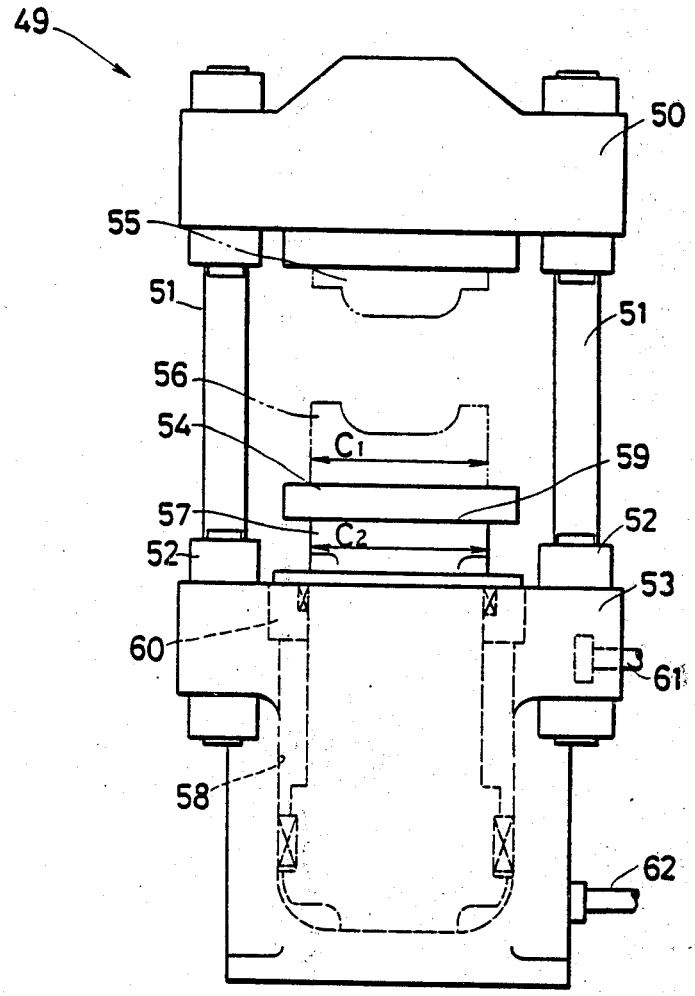
FIG. 6 is a side elevational view of one structural example of the another practical embodiment (the second embodiment) of the invention.

FIG. 6 shows an embodiment of the "hydraulic press" in accordance with a second form of the invention. The hydraulic press, generally designated at a numeral 49, has an upper frame 50, post 51, nut 52, pressure cylinder and lower frame 53, table 54, upper mold part 55 and a lower mold part 56. A slidable member 57, generally known as a ram, is received by the pressure chamber 58 in the pressure cylinder or lower frame 53 for free sliding motion in the back and forth direction. The lower end surface 59 of the slidable member 57 is shaped and sized as $C_2$ in conformity with the polygonal shape $C_1$ of the mold part (lower mold part 56 in the illustrated embodiment). The portions other than the end surface portion 59 of the slidable member 57 has a polygonal cross-section as in the cases of the slidable members 12 and 32 of the preceding two embodiments of the pressure cylinder apparatus. A stopper assembly 60 combined with the slidable member 57 has an aperture of the polygonal shape corresponding to the cross-section of the slidable member 57, as in the case of the stopper assemblies 18 and 38 of two embodiments described before. Reference numerals 61 and 62 denote pipes for charging and discharging oil.

In operation, as the pressurized oil is supplied from the pipe 62, the slidable member 57 is moved outwardly of the cylinder, i.e. upwardly, without rotating around its own axis, while being guided by the stopper assembly 60, so that the lower mold part 56 is pressed against the upper mold part 55 provided on the upper frame 50 thereby to effect the desired press work. Then, pressurized oil is supplied through the pipe 61 so that the slidable member 57 is retracted downwardly without making any rotation. In this reciprocatory motion of the slidable member 57, the lower mold part 56 is moved only linearly but not rotatingly because the slidable member 57 having a polygonal cross-section is stably guided by the stopper assembly 60 which has an aperture of the corresponding polygonal shape. In consequence, the lower mold part 56 can be positioned with respect to the upper mold part 55 at an extremely high precision to permit a highly precise press work.

The embodiment shown in FIG. 6 is not exclusive, for instance, it is of course possible to attach the "pressure cylinder" to the upper frame of the press so that the upper mold part secured to the lower end of the slidable member is moved towards and away from the lower mold part.

In addition, the substantially square cross-sections of the slidable members 12, 32 and 57 employed in the preceding embodiments are only illustrative and the slidable members can have any other suitable polygonal cross-sectional shapes. In such a case, the apertures in the stopper assemblies 18,38 and 60, and lower mold part 56 should have corresponding polygonal shape to the cross-section of the slidable member.

As has been described, according to the present invention, the slidable member is made to have a polygonal cross-section and is combined with a stopper assembly which has an aperture of a polygonal shape substantially in conformity with the polygonal shape of the slidable member, so that the slidable member is allowed only to move linearly but not to rotate around its own axis. In consequence, when a pressing force is applied to another member through the slidable member, it is possible to correctly apply the pressing force to the member without substantial deviation of position. It is quite advantageous that this remarkable effect can be achieved without requiring any specific and separate device or means for preventing the rotation of the slidable member, in the pressure cylinder apparatus of the first form of the invention.

Furthermore, by making the end surface portion of the slidable member have a shape and size corresponding to those of the mold part of the press which is secured to the end surface portion as in the described embodiment of the second form of the invention, it is possible to enjoy the same advantage as that achieved in the first form of the invention. Namely, it is possible to omit specific and separate device or means such as guide bars for preventing the rotation of the slidable member, and the construction of the hydraulic press as a whole is simplified remarkably. In addition, the apparatus of the invention permits a direct attaching of the press mold part to the end surface of the slidable member without necessitating any table. Even if the table is used, the thickness of the table can be reduced to the minimum thickness required for the attaching to the press mold part, and unfavourable deflection which often take place in four corners of the table is avoided to permit an application of uniform pressure on the work while enhancing the precision of the press work.

What is claimed:

1. A pressure cylinder apparatus comprising a cylinder and a slidable member adapted to be moved back and forth in the axial direction in said cylinder in response to a charging and discharging of a fluid into and out of said cylinder, wherein said slidable member has a polygonal cross-sectional shape and a stoppper assembly having an aperture slidably receiving said slidable member and having a polygonal shape substantially conforming with the cross-sectional shape of said slidable member is provided in the plane perpendicular to the direction of movement of said slidable member.

2. A pressure cylinder apparatus according to claim 1, wherein said stopper assembly includes a stuffing box, packing and packing gland and a packing retainer, and serves also as a seal for preventing fluid leakage out of the pressure chamber defined in said cylinder.

3. A pressure cylinder apparatus according to claim 2, wherein said stuffing box, said packing and packing gland and said packing each have an aperture of a polygonal shape.

4. A pressure cylinder apparatus according to claim 1, wherein said cylinder and said slidable member are of single acting type.

5. A pressure cylinder apparatus according to claim 1, wherein said cylinder and said slidable member are of double acting type.

6. A hydraulic press comprising a cylinder, a slidable member adapted to be moved back and forth in said cylinder in response to charge and discharge of a fluid into and out of said cylinder, said slidable member having a polygonal cross-sectional shape, a stopper assembly provided in the direction of movement of said slidable member and having an aperture of a polygonal shape substantially conforming with the polygonal cross-sectional shape of said slidable member, said stopper assembly being disposed to extend in a plane perpendicular to the direction of movement of said slidable member, and a press mold part secured to the end surface portion of said slidable member, said end surface portion having a size and shape corresponding to those of said press mold part.

7. A hydraulic press according to claim 6, wherein said end surface portion of said slidable member has a polygonal shape and size corresponding to those of said press mold part.

8. A hydraulic press according to claim 6, wherein said stopper assembly has a stuffing box, packing and packing gland, and a packing retainer, and serves also as a seal for preventing fluid from leaking out of the pressure chamber in said cylinder.

9. A hydraulic press according to claim 6, wherein said stuffing box, packing and packing gland and said packing retainer have apertures of a polygonal shape.

10. A hydraulic press according to claim 6, wherein a lower mold part is secured to said slidable member.

11. A hydraulic press according to claim 6, wherein an upper mold part is secured to said slidable member.

* * * * *

UNITED STATES PATENT AND TRADEMARK OFFICE

CERTIFICATE OF CORRECTION

PATENT NO. : 4,445,840

DATED : May 1, 1984

INVENTOR(S) : Kenmochi et al.

It is certified that error appears in the above-identified patent and that said Letters Patent is hereby corrected as shown below:

Column 6, line 13, please change "packing each" to ---packing retainer each---.

Signed and Sealed this

*Thirtieth* Day of *October 1984*

[SEAL]

*Attest:*

GERALD J. MOSSINGHOFF

*Attesting Officer*

*Commissioner of Patents and Trademarks*